United States Patent [19]

Reed

[11] 4,072,632

[45] Feb. 7, 1978

[54] DISHWASHING COMPOSITIONS

[75] Inventor: David Alan Reed, Wallasey, England

[73] Assignee: Lever Brothers Company, New York, N.Y.

[21] Appl. No.: 639,498

[22] Filed: Dec. 10, 1975

Related U.S. Application Data

[63] Continuation of Ser. No. 345,796, March 28, 1973, abandoned.

[30] Foreign Application Priority Data

Apr. 6, 1972 United Kingdom ..... 15832/72

[51] Int. Cl.[2] ..... C11D 1/12; C11D 1/14; C11D 1/28; C11D 1/27

[52] U.S. Cl. ..... 252/541; 252/523; 252/526; 252/532; 252/533; 252/538; 252/545; 252/551; 252/552; 252/557

[58] Field of Search ..... 252/121, 354, 531, 532, 252/538, 550, 551, 557, 552, 70, 523, 541, 533, 55; 106/13

[56] References Cited

U.S. PATENT DOCUMENTS

| | | | |
|---|---|---|---|
| 2,028,091 | 1/1936 | Jaeger | 252/557 X |
| 2,181,087 | 11/1939 | Caryl | 252/121 X |
| 2,295,831 | 9/1942 | Caryl | 252/538 |
| 2,296,767 | 9/1942 | Caryl | 252/557 X |
| 2,813,078 | 11/1957 | Vitalis | 252/557 |
| 2,950,255 | 8/1960 | Goff | 252/547 X |
| 2,987,484 | 6/1961 | Lundberg | 252/551 X |
| 3,206,408 | 9/1965 | Vitalis | 252/557 |
| 3,401,007 | 9/1968 | Hoffmann | 252/121 X |
| 3,625,906 | 12/1971 | Alsbury | 252/121 |
| 3,793,233 | 2/1974 | Rose | 252/547 |

OTHER PUBLICATIONS

Hayashi, Y. "Antifogging Agents for Glass", Chemical Abstracts, vol. 82, 113494a, 1975.

*Primary Examiner*—Dennis L. Albrecht
*Attorney, Agent, or Firm*—Kenneth F. Dusyn; James J. Farrell; Melvin H. Kurtz

[57] ABSTRACT

A detergent active mixture of a dialkyl ($C_7$-$C_9$) ester of sulphosuccinic acid and a sulphate $R(OC_2H_4)_nOSO_3M$ wherein R is alkyl, linear or branched, primary or secondary, having 11–18 carbon atoms, *n* is 0–40 when R is derived from a primary alcohol and 2–40 when derived from a secondary alcohol and M is an alkali metal ammonium or substituted ammonium ion, gives synergistic lather stability in hand dishwashing.

7 Claims, No Drawings

DISHWASHING COMPOSITIONS

This is a continuation of application Ser. No. 345,796, filed Mar. 28, 1973, now abandoned.

The present invention relates to dishwashing compositions.

Dishwasing compositions are formulated to remove food soils and to provide a lather. The quantity and stability of the lather is a very important factor in dishwashing since the user often equates the cleaning power of the product to the lather persistence.

It is well known that the lather from dishwashing compositions tends to be unstable to food soils and its collapse can lead to the user believing that the composition is not efficient.

The present invention provides a dishwashing composition which is effective in hand dishwashing in removing food soils and which also has a lather which is more stable than would be expected from the lather performance of the ingredients separately.

Accordingly, the present invention provides a foaming, dishwashing composition whose active detergent material comprises a di-alkyl ($C_7$–$C_9$) ester of sulphosuccinic acid in conjunction with a sulphate of formula $R(OC_2H_4)_nOSO_3M$ wherein R is alkyl, linear or branched, having 11–18 carbon atoms; $n$ is 0–40 when R is derived from a primary alcohol and 2–40 when R is derived from a secondary alcohol; and M is an alkali metal, ammonium or substituted ammonium ion.

The di-alkyl sulphosuccinate is the alkali metal, ammonium or substituted ammonium salt, and may be derived from a $C_7$, $C_8$ or $C_9$ alcohol which may be linear or branched, or any mixture thereof. The preferred material is di-n-octyl sulphosuccinate. The di-alkyl sulphosuccinate may be prepared by conventional routes, e.g. esterification of maleic acid followed by sulphonation with bisulphite.

The sulphates are well known anionic synthetic detergents, and are sulphuric acid half esters of either alkanols (i.e. where $n = 0$) or ethoxylated alkanols (i.e. where $n = 1$–40). Suitable sulphates are from the linear, branched, primary or secondary alcohols, with or without ethoxylation. Preferred alcohols are:

1. the linear primary alcohols having 12-14 carbon atoms, which, if ethoxylated, have up to 12 mols ethylene oxide per mol of alcohol;

2. the mainly straight chain primary alcohols having 2-15 carbon atoms and about 25% 2-methyl branching, which, if ethoxylated, have up to 12 mols ethylene oxide per mol of alcohol;

3. the random secondary alcohols having 11–15 carbon atoms having 7–30 mols ethylene oxide per mol of alcohol.

The preferred cations are sodium and ammonium, and the latter sulphates can be an aid to hydrotroping of the liquid compositions of the invention.

The mixtures described in this invention were assessed by measuring the foam performance using a modified Schlachter-Dierkes test which is based on the principle described in Fette und Seifen 1951, vol. 53 page 207. A 100 ml aqueous solution of the dishwashing liquid at 0.04% a.d. in 24° H water (i.e. 24 parts calcium carbonate per 100,000 parts water) at 45° C is rapidly agitated using a vertically oscillating perforated disc within a graduated cylinder. After the initial generation of foam, increments (0.2 g) of soil (9.5 parts commercial cooking fat, ¼ part oleic acid, ¼ part stearic acid, dispersed in 120 parts water and the emulsion stabilised with 10 parts wheat starch) are added at 15 second intervals (comprising 10 seconds mild agitation and 5 seconds rest) until the foam collapses. The result is recorded as the number of oil increments (NSI score). Conventional dishwashing compositions record not more than 35 as their NSI score. Many of the compositions of this invention will record considerably higher NSI score.

It has been found surprisingly that the specified alkyl group of the sulphosuccinate is very critical for optimum foam stability. This is demonstrated in the following table which shows the foam stability of various di-alkyl sulphosuccinates in admixture (1/1 by weight) with the following sodium alkyl ether sulphates: (a) Empimin 3023 (RTM) (sulphate of lauryl alcohol ethoxylated with 10 mols ethylene oxide per mol of alcohol, ex Marchon Products Ltd), and (b) Tergitol 15-S-12-S (RTM) (sulphate of the random $C_{11-15}$ secondary alcohol ethoxylated with 12 mols ethylene oxide per mol of alcohol, ex Union Carbide & Chemical Corporation).

| Carbon chain of di-alkyl sulphosuccinate | NSI Score | |
|---|---|---|
| | Sulphate (a) | Sulphate (b) |
| n - $C_4$ | 1 | — |
| n - $C_6$ | 2 | 2 |
| n - $C_7$ | 22 | 43 |
| n - $C_8$ | 55 | 70 |
| n - $C_9$ | 26 | 17 |
| n - $C_{10}$ | 4 | 8 |
| 2-ethyl hexyl | 22 | 31 |
| 3,5,5, trimethyl hexyl | 31 | 43 |
| isobutyl | 2 | 2 |

The above results show the surprisingly effective chain length of the di-alkyl sulphosuccinate as $C_7$ to $C_9$, n - $C_8$ being the optimum.

It is surprising that the combination of the di-alkyl ($C_7$-$C_9$) sulphosuccinate and the alkyl ether sulphate is so efficient because the sulphosuccinate alone shows very poor foam performance. Even the alkyl ether sulphate has a surprisingly enhanced performance in admixture with the di-alkyl sulphosuccinate.

It will be appreciated that the sulphates will probably include some unreacted alcohol or ethoxylated alcohol, by virtue of its incomplete conversion to the sulphate. In the examples quoted in this specification, the percentage of unreacted alcohol in the sulphates used was of the order of 1–10% by weight of the sulphate. Experimental evidence showed that a content of unreacted alcohol up to 20% by weight of the sulphate is insufficient to affect to NSI score.

The ratio by weight of di-alkyl sulphosuccinate to alkyl (ether) sulphate can range from 10:90 to 99:1, preferably about 1:1. The amount by weight of di-alkyl sulphosuccinate/sulphate mixture can range from 5% to 100%, preferably 10–60% of the composition. Preferably the dialkyl sulphosuccinate is present in amount more than 5% by weight of the composition.

The product may include other detergents, hydrotropes, solvents, opacifiers, phosphates, silicates, colourants, perfumes, enzymes, and skin benefit agents. Selection of other detergents must necessarily ensure maintenance of the lather stability attained by the compositions of the invention.

Whilst this invention is primarily concerned with liquid compositions, it is applicable to powder compositions.

The invention will now be described by way of example of mixtures of a di-alkyl sulphosuccinate and a sulphate in water. The foam stability was determined by the NSI test hereinbefore described. The NSI scores expected from knowledge of the NSI scores of the components as sole actives are given in brackets. The percentages of the active detergent incredients are by weight of the total active detergent material which is at a concentration of 0.04% throughout.

The results given below in Examples 1–4 show the synergistic effect obtained by the mixture according to the invention. The controls are included for completeness.

EXAMPLE 1

Sodium sulphates prepared from various Dobanol 25 (RTM) ethoxylates, commercially available from Shell Chemical Company, were used. Dobanol 25 (RTM) is believed to be mainly a primary linear alcohol ($C_{12-15}$) with about 25% of 2-methyl branching.

The results were as follows:

| % by weight active material | | | | | |
|---|---|---|---|---|---|
| | Sodium di-n-octyl sulphosuccinate | Sulphate | NSI score when n = 0 | 3 | 6 |
| (Control) | 100 | 0 | 3 | 3 | 3 |
| | 90 | 10 | 22(5) | 54(5) | 50(3) |
| | 80 | 20 | 26(6) | 32(6) | 35(3) |
| | 70 | 30 | 25(8) | 35(8) | 36(3) |
| | 60 | 40 | 27(10) | 38(9) | 40(3) |
| | 50 | 50 | 28(12) | 42(10) | 42(3) |
| | 40 | 60 | 30(14) | 44(12) | 44(4) |
| | 20 | 80 | 27(18) | 27(14) | 13(4) |
| (Control) | 0 | 100 | 21 | 16 | 4 |

EXAMPLE 2

Sodium sulphates of random secondary alcohol ($C_{11-15}$) ethoxylates, commercially available as the Tergitol 15-S (RTM) series from Union Carbide Chemical Corporation, were used. Those believed to contain an average of 7 and 12 moles of ethylene oxide/mole respectively were used. An ethoxylate having an average of 30 moles of ethylene oxide/mole random secondary alcohol ($C_{11-15}$) was synthesised and sulphated. The results were as follows:

| % by weight active material | | | | | |
|---|---|---|---|---|---|
| | Sodium di-n-octyl Sulphosuccinate | Alkyl sulphate | NSI score when n = 7 | 12 | 30 |
| (Control) | 100 | 0 | 3 | 3 | 3 |
| | 90 | 10 | 26(3) | 34(3) | 30(3) |
| | 80 | 20 | 40(3) | 50(3) | 42(2) |
| | 70 | 30 | 53(3) | 66(3) | 31(2) |
| | 60 | 40 | 65(3) | 73(3) | 28(2) |
| | 50 | 50 | 67(3) | 70(2) | 40(2) |
| | 40 | 60 | 61(3) | 62(2) | 36(1) |
| | 20 | 80 | 41(3) | 18(2) | 22(1) |
| (Control) | 0 | 100 | 3 | 2 | 1 |

EXAMPLE 3

Empimin 3003 (RTM) (sulphate of lauryl alcohol ethoxylated with 3 mols EO per mol of alcohol) and Empimin 3023 (RTM) (described earlier) were used. These ether sulphates which contain an average of 3 and 10 ethylene oxide units/molecule respectively are derived from a narrow cut coconut alcohol and are available from Marchon Products Limited.

The results were as follows:

| % by weight active material | | | | |
|---|---|---|---|---|
| | Sodium di-n-octyl sulphosuccinate | Ether sulphate | NSI score when n = 3 | 10 |
| (Control) | 100 | 0 | 3 | 3 |
| | 90 | 10 | 47(4) | 41(3) |
| | 80 | 20 | 29(5) | 25(3) |
| | 70 | 30 | 35(6) | 45(3) |
| | 60 | 40 | 42(6) | 47(3) |
| | 50 | 50 | 46(7) | 55(2) |
| | 40 | 60 | 45(8) | 47(2) |
| | 20 | 80 | 37(10) | 25(2) |
| (Control) | 0 | 100 | 11 | 2 |

EXAMPLE 4

Sodium sulphates of Alfol 12-14 and Alfol 1214-7EO (commercially available from Condea) were used.

The results were as follows:

| % by weight active material | | | | |
|---|---|---|---|---|
| | Sodium di-n-octyl sulphosuccinate | Alkyl sulphate | NSI score when n = 7 | 0 |
| (Control) | 100 | 0 | 3 | 3 |
| | 90 | 10 | 48(3) | 22(4) |
| | 80 | 20 | 29(3) | 30(6) |
| | 70 | 30 | 35(3) | 47(7) |
| | 60 | 40 | 42(3) | 41(9) |
| | 50 | 50 | 47(2) | 46(10) |
| | 40 | 60 | 41(2) | 33(11) |
| | 20 | 80 | 13(2) | 26(14) |
| (Control) | 0 | 100 | 2 | 17 |

Examples 5–7 demonstrate liquid dishwashing compositions according to the present invention.

EXAMPLE 5

| | |
|---|---|
| Ammonium di-n-octyl sulphosuccinate | 12.5 |
| Ammonium random sec. ($C_{11-15}$) alcohol-12 ethylene oxide sulphate | 12.5 |
| Urea | 12.5 |
| Ethanol | 7.5 |
| Perfume, water, etc. | to 100 |
| 0.16 gms in 100 mls 24° H water --- NSI score = 70 | |

EXAMPLE 6

| | |
|---|---|
| Sodium di-n-octyl sulphosuccinate | 6 |
| Sodium random secondary ($C_{11-15}$) alcohol-7 ethylene oxide sulphate | 24 |
| Tertiary pentanol | 10 |
| Perfume, water, etc. | to 100 |
| 0.13 gms in 100 mls 24° H water --- NSI score = 41 | |

EXAMPLE 7

| | |
|---|---|
| Sodium di-alkyl ($C_{7-9}$) sulphosuccinate (from Linevol 79* RTM) | 20 |
| Sodium alkyl ($C_{12-15}$) 3EO sulphate (from Dobanol 25 RTM) | 20 |
| Ethanol | 10 |
| Urea | 10 |
| Perfume, water, etc. | to 100 |
| 79 RTM is $C_7$–$C_9$ alcohol ex ICI) | |
| 0.1 gms in 100 mls 24° H water --- NSI score = 40 | |

The best conventional dishwashing liquid compositions at the same a.d. of 0.04% gives an NSI score of 35. Examples 8–10 demonstrate powder dishwashing compositions according to the present invention.

EXAMPLE 8

| | |
|---|---|
| Sodium di-n-octyl sulphosuccinate | 30 |
| Sodium lauryl sulphate | 30 |
| Sodium tripolyphosphate | 10 |
| Sodium sulphate | 30 |
| 0.07 gm in 100 mls 24° H water --- NSI score = 48 | |

EXAMPLE 9

| | |
|---|---|
| Sodium di-n-octyl sulphosuccinate | 15 |
| Lauryl 10 EO sulphate | 15 |
| Sodium tripolyphosphate | 10 |
| Sodium silicate | 5 |
| Sodium sulphate | 55 |
| 0.13 gms in 100 mls 24° H water --- NSI score = 58 | |

EXAMPLE 10

| | |
|---|---|
| Sodium di-n-octyl sulphosuccinate | 45 |
| Sodium alkyl ($C_{12-15}$) 3 EO sulphate | 5 |
| Sodium sulphate | 50 |
| 0.08 gms in 100 mls 24° H water --- NSI score = 54 | |

The foregoing compositions have a satisfactory dishwashing performance. Although the above performances are demonstrated in 24° H water, equivalent or better performances ae obtained in soft water (4° H).

What is claimed is:

1. A lather stable dishwashing detergent composition comprising a mixture of:

a. a dialkyl ester salt of a sulphosuccinic acid wherein each alkyl radical is selected from the group consisting of heptyl, octyl and nonyl and the cation is selected from the group consisting of an alkali metal and ammonium; and b. a sulphate of the formula $R(OC_2H_4)_nOSO_3M$ wherein R contains from 11 to 18 carbon atoms and is selected from the group consisting of linear alkyl, branched alkyl and mixtures of linear and branched alkyl, *n* is an integer from 1 to 40 when R is derived from a primary alcohol, and 2 to 40 when R is derived from a secondary alcohol; and M is a cation selected from an alkali metal and ammonium;

components (a) and (b) above being present in a weight ratio in the range of from 10:90 to 99:1.

2. The lather stable dishwashing detergent composition defined in claim 1 wherein the weight ratio of component (a) to component (b) is from 90:10 to 20:80.

3. The lather stable dishwashing detergent composition defined in claim 1 wherein the weight ratio of component (a) to component (b) is about 1.1.

4. The lather stable dishwashing detergent composition defined in claim 1 wherein component (a) is a di-n-octylsulfosuccinate.

5. A lather stable dishwashing detergent composition whose active detergent material comprises a mixture of:

a. an alkali metal or ammonium di-n-octylsulfosuccinate; and b. a sulphate of the formula $R(OC_2H_4)_nOSO_3M$ wherein R is a linear primary alkyl group having 12 to 14 carbon atoms, *n* is 1 to 12, and M is a cation selected from the group consisting of an alkali metal and ammonium, components (a) and (b) being present in a weight ratio of from 10:90 to 99:1.

6. A lather stable dishwashing detergent composition whose active detergent material comprises a mixture of:

a. an alkali metal or ammonium di-n-octylsulphosuccinate; and b. a sulphate of the formula $R(OC_2H_4)_n\ OSO_3M$ wherein R is a primary alkyl group having 12 to 15 carbon atoms and about 25% methyl branching, *n* is 1 to 12, and M is a cation selected from the group consisting of an alkali metal and ammonium, components (*a*) and (*b*) being present in a weight ratio of from 10:90 to 99:1.

7. A lather stable dishwashing detergent composition whose active detergent material comprises a mixture of:

a. an alkali metal or ammonium di-n-octylsulphosuccinate; and b. a sulphate of the formula $R(OC_2H_4)_nOSO_3M$ wherein R is a random secondary alkyl group having 11 to 15 carbon atoms, *n* is 7 to 30, and M is a cation selected from the group consisting of an alkali metal and ammonium, components (a) and (b) being present in a weight ratio of from 10:90 to 99:1.

* * * * *